US007857198B2

(12) United States Patent
Bell

(10) Patent No.: US 7,857,198 B2
(45) Date of Patent: Dec. 28, 2010

(54) DEVICE FOR PROCESSING SHEET OBJECTS SUCH AS BANKNOTES

(75) Inventor: Malcolm Reginald Hallas Bell, Leeds (GB)

(73) Assignee: Money Controls Limited, Royton Oldham (GB)

( * ) Notice: Subject to any disclaimer, the term of this patent is extended or adjusted under 35 U.S.C. 154(b) by 213 days.

(21) Appl. No.: 11/720,220

(22) PCT Filed: Nov. 25, 2005

(86) PCT No.: PCT/EP2005/056228

§ 371 (c)(1),
(2), (4) Date: May 25, 2007

(87) PCT Pub. No.: WO2006/056599

PCT Pub. Date: Jun. 1, 2006

(65) Prior Publication Data

US 2008/0006682 A1 Jan. 10, 2008

(30) Foreign Application Priority Data

Nov. 26, 2004 (GB) ..... 0426137.6

(51) Int. Cl.
*A45C 1/12* (2006.01)

(52) U.S. Cl. ..... 232/1 D; 232/16; 235/379; 109/38; 194/206

(58) Field of Classification Search ..... 232/15–16, 232/1 D, 43.2; 271/145; 235/379; 109/38, 109/52; 194/206; 340/572.1, 691.6
See application file for complete search history.

(56) References Cited

U.S. PATENT DOCUMENTS

| | | | | |
|---|---|---|---|---|
| 4,186,977 A | | 2/1980 | Gilovich et al. | |
| 4,275,667 A | * | 6/1981 | Hilton | 109/44 |
| 4,283,097 A | * | 8/1981 | Lundblad | 109/52 |
| 4,348,656 A | * | 9/1982 | Gorgone et al. | 382/135 |
| 4,380,316 A | | 4/1983 | Glinka et al. | |
| 4,552,075 A | * | 11/1985 | Glasson et al. | 109/52 |
| 4,570,548 A | | 2/1986 | Martin et al. | |

(Continued)

FOREIGN PATENT DOCUMENTS

DE 2949344 6/1980

(Continued)

OTHER PUBLICATIONS

Written PCT Search Report for PCT/EP2005/056228 dated Jun. 7, 2007.

(Continued)

*Primary Examiner*—William L. Miller
(74) *Attorney, Agent, or Firm*—Orrick Herrington & Sutcliffe, LLP

(57) ABSTRACT

A device for processing sheet objects comprises a tamper proof housing that contains an opening device operable to receive a container containing sheet objects such as banknotes from outside the housing and to open the container within the housing, and a counter configured to count sheet objects from the opened container within the housing and produce a count signal corresponding to the number of sheet objects counted. The count signal can be checked against reference data received from another location or derived from data carried in the container on a RFID tag.

17 Claims, 13 Drawing Sheets

U.S. PATENT DOCUMENTS

| | | | | |
|---|---|---|---|---|
| 4,659,008 | A * | 4/1987 | Howett et al. | 232/43.3 |
| 4,714,029 | A | 12/1987 | Idegren et al. | |
| 5,553,320 | A | 9/1996 | Matsuura et al. | |
| 5,662,201 | A * | 9/1997 | Gerlier et al. | 194/206 |
| 5,996,888 | A * | 12/1999 | Gromatzky | 232/15 |
| 6,065,672 | A | 5/2000 | Haycock | |
| 6,193,149 | B1 * | 2/2001 | Hesoun | 232/1 D |
| 6,244,504 | B1 * | 6/2001 | Holland-Letz | 232/15 |
| 2002/0060400 | A1 | 5/2002 | Kobayashi et al. | |
| 2002/0079361 | A1 | 6/2002 | Kosugi | |
| 2003/0000957 | A1 | 1/2003 | Brexel et al. | |
| 2007/0102439 | A1 * | 5/2007 | Bell | 220/789 |

FOREIGN PATENT DOCUMENTS

| | | | |
|---|---|---|---|
| DE | 19640574 | A1 | 4/1998 |
| EP | 0540867 | A3 | 5/1993 |
| EP | 0600848 | A2 | 6/1994 |
| WO | WO2006/056599 | | 6/2006 |

OTHER PUBLICATIONS

PCT International Search Report.
PCT Written Opinion of the International Searching Authority.

* cited by examiner

DEVICE FOR PROCESSING SHEET OBJECTS SUCH AS BANKNOTES

FIELD OF THE INVENTION

This invention relates to a device for processing sheet objects such as banknotes, and has particular application to a device for opening a container containing sheet objects.

BACKGROUND

In our application GB 0327522.9 we describe a container into which sheet objects such as banknotes are packaged, such that the container is sealed and cannot be opened without rendering the container unsuitable for use, so as to reduce the risk of pilfering from the container. The container may be filled at a point of sale, such as a checkout at a supermarket, using a packaging device which can validate the banknotes and count them. The packaging device seals a closure member onto the container, so that it can be transported with a low risk of pilfering to another location such as an amounting office for the supermarket or a bank. The packaging device can develop data concerning the number, denomination and value of the banknotes in the container. The data concerning the banknotes in the container can be recorded by means of a printer on the container, for example on the inside of the closure member, or on a RFID tag within the container.

The present invention is concerned with an improved device for opening a container that contains sheet objects such as banknotes, in which the risk of pilfering is materially reduced.

SUMMARY OF THE INVENTION

According to the present invention there is provided a device for processing sheet objects, comprising a housing that contains an opening device operable to receive a container containing sheet objects from outside the housing and to open the container within the housing, and a counting device to count sheet objects from the opened container within the housing and produce a count signal corresponding to the number of sheet objects counted.

Pat. App: A Device for Processing Sheet Objects Such As Banknotes

Since both the opening of the container and the counting of its contents is carried out within the housing, the risk of pilfering of banknotes during the counting process, is materially reduced.

The device may include a denomination sensor to sense the denomination of sheet objects from the container and a sorter may sort the counted sheet objects according to their denomination as sensed by the denomination sensor.

The housing may contain sheet feeding means to feed sheet objects from the opened container to the counting device.

The opening device may be configured to open a container of resiliently deformable material that is sealed shut with the sheet objects therein, for example by bursting the container.

The housing may include a door operable to allow the container containing sheet objects to inserted therein to be opened by the opening device and the opening device may only be operable when the door is closed.

Processing circuitry responsive to the count signal, may be configured to compare the value of the count signal with reference data corresponding to the number of sheet objects within the container. The reference data may be contained within the container, and the device may include a detector to detect the reference data. For example the reference data may be held on a RFID tag in the container in which case the detector comprises a RFID tag reader to detect the reference data from the tag. Also, the processing circuitry may include an input to receive the reference data from a remote location.

The processor may be configured to provide an alarm signal if the count signal does not correspond to the reference data. Alternatively, the processor may be configured to provide an alarm signal if the number of notes of a particular denomination does not correspond to the reference data. Alternatively, the processor may be configured to provide an alarm signal if the total monetary value attributed to the notes does not correspond to the reference data.

BRIEF DESCRIPTION OF THE DRAWINGS

In order that the invention may be more fully understood an embodiment thereof will now be described by way of example with reference to the accompanying drawings in which.

DETAILED DESCRIPTION

Figure 1:
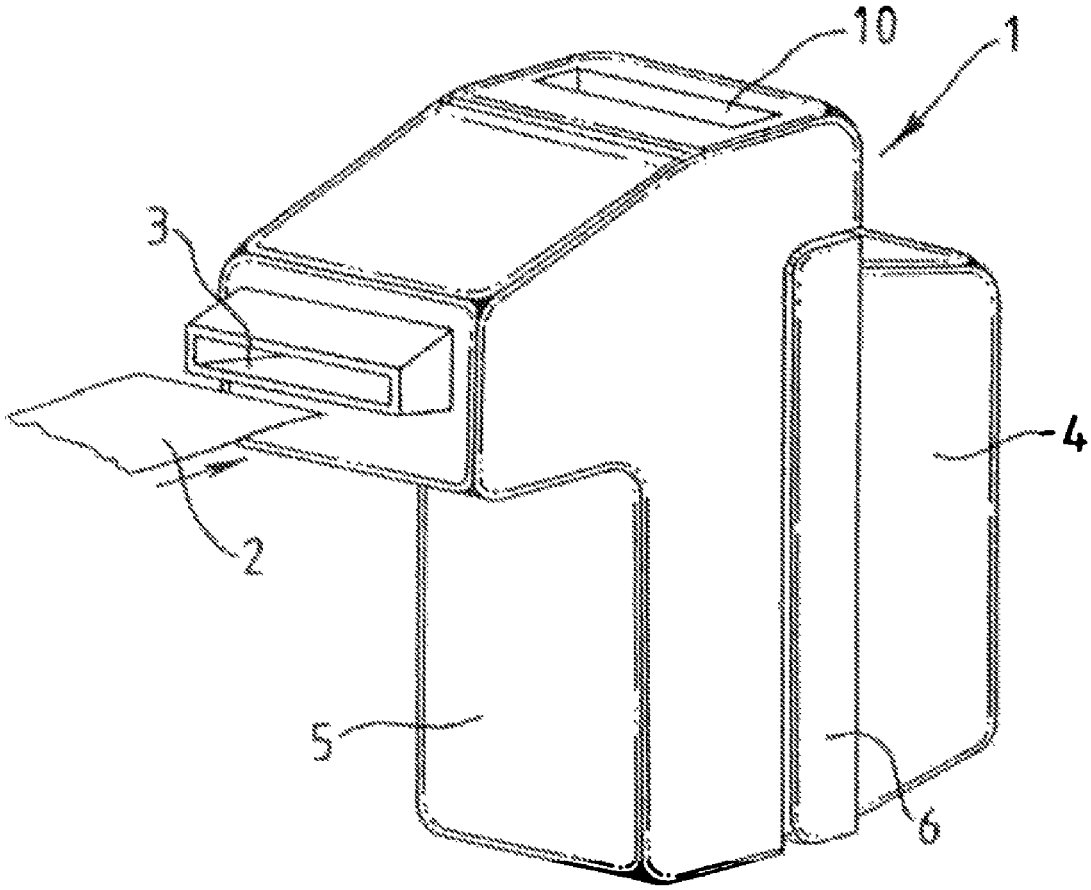
FIG. 1 is a schematic perspective view of a packaging device and associated single use container in accordance with the invention, in a closed configuration with the container fitted ready for use.

In the following description, an example of a packaging device which corresponds to that described in our application GB 0327522.9, will be described, for packaging sheet objects such as banknotes in a sealed container. Then an example of a device according to the invention will be described, for removing and counting the sheet objects from the container.

The devices illustrated in the drawings are for packaging and unpackaging banknotes, and as used herein, the term "banknote" means a promissory note especially from a central bank or other governmental organisation payable to the bearer on demand for use as money, also known as "paper money" and in the USA as "currency" or a "bill".

Referring to FIG. 1, a packaging device 1 is configured to receive individual banknotes 2 through an input slot 3 and stack them in a removable container 4. The packing device 1 may be mounted at a point of sale in a retail outlet, for example at a checkout in a supermarket so that banknotes can be packaged in the container 4 and then transported securely to a remote location, such as a cashier's office or a bank.

The packaging device 1 comprises a main body 5 and a frame 6 mounted on the main body 5 to receive the container 4. The frame 6 is hinged on the main body 5 in this example, so that it can be moved between a closed position shown in FIG. 1 to an open position shown in FIG. 2, to act as a docking mechanism that allows the container 4 to be inserted and removed between the frame 6 and the main body 5. The container 4 is generally rectangular in configuration to be described in more detail hereinafter, with a peripheral lip 7. The frame 6 defines an output port 8 through which the container 4 protrudes as shown in FIG. 1, with its lip 7 sandwiched between the main body 5 and the frame 6.

Figure 2:
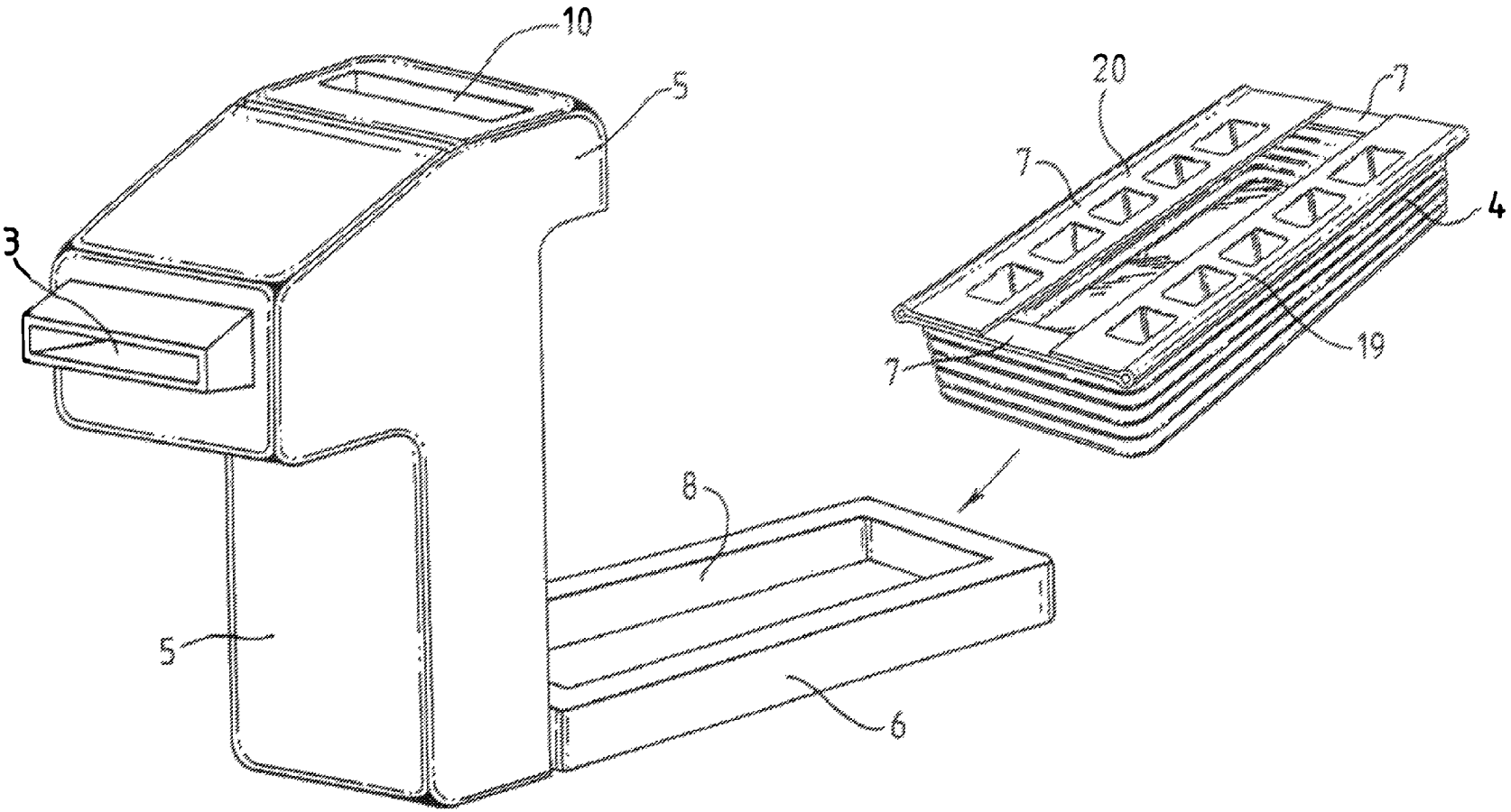
FIG. 2 corresponds to the view of FIG. 1 but with the device open to receive the container, prior to use.
Figure 3:
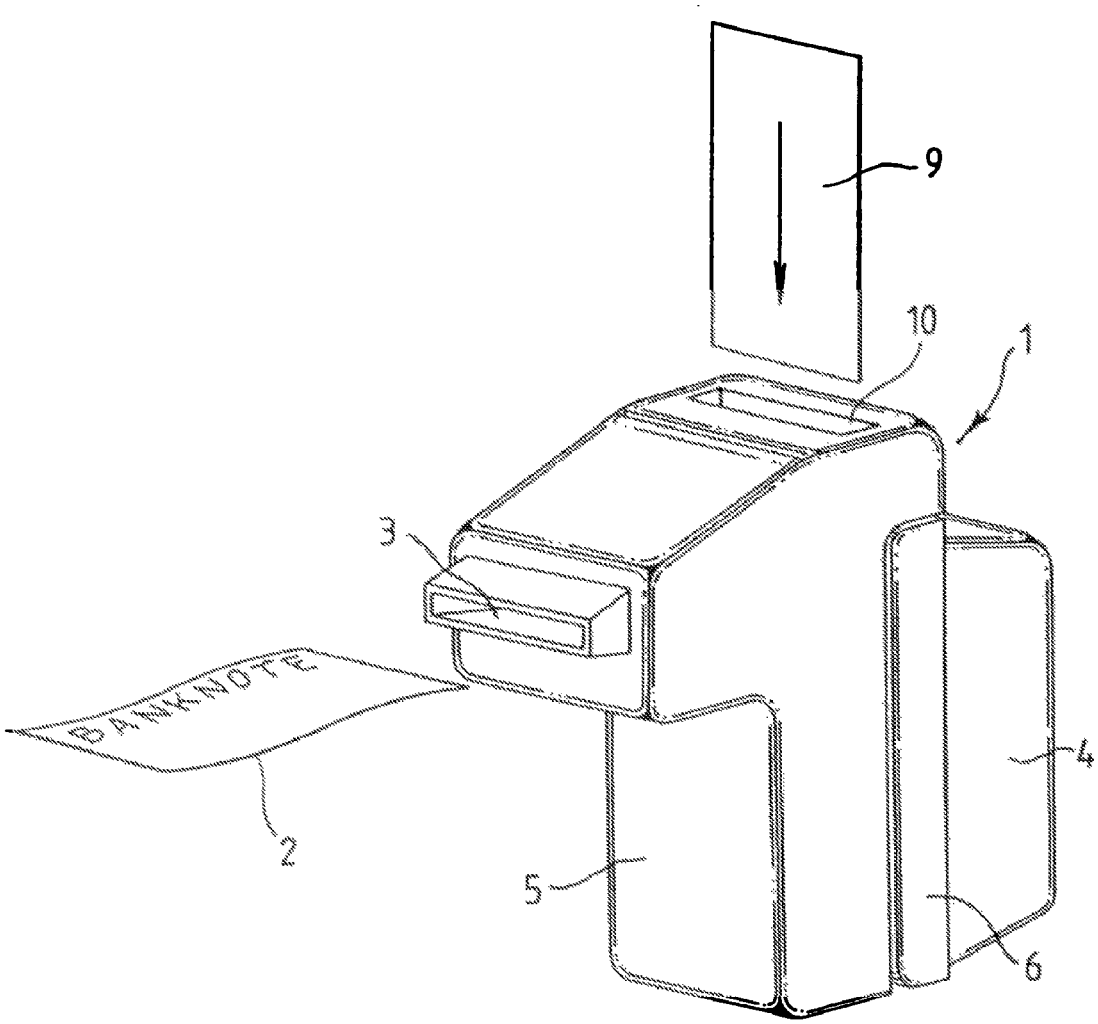
FIG. 3 corresponds to FIG. 1 and shows the insertion of a closure member that is sealed to the container.

Referring to FIG. 3, when the container becomes full of banknotes 2, a closure member in the form of a sealing card 9 is inserted through a second input port 10 in the main body 5, to be heat sealed onto the container 4. Thus, when the frame 6 is opened as shown in FIG. 2, a sealed container is provided containing the banknotes for transport to the cashier's office.

Figure 4:
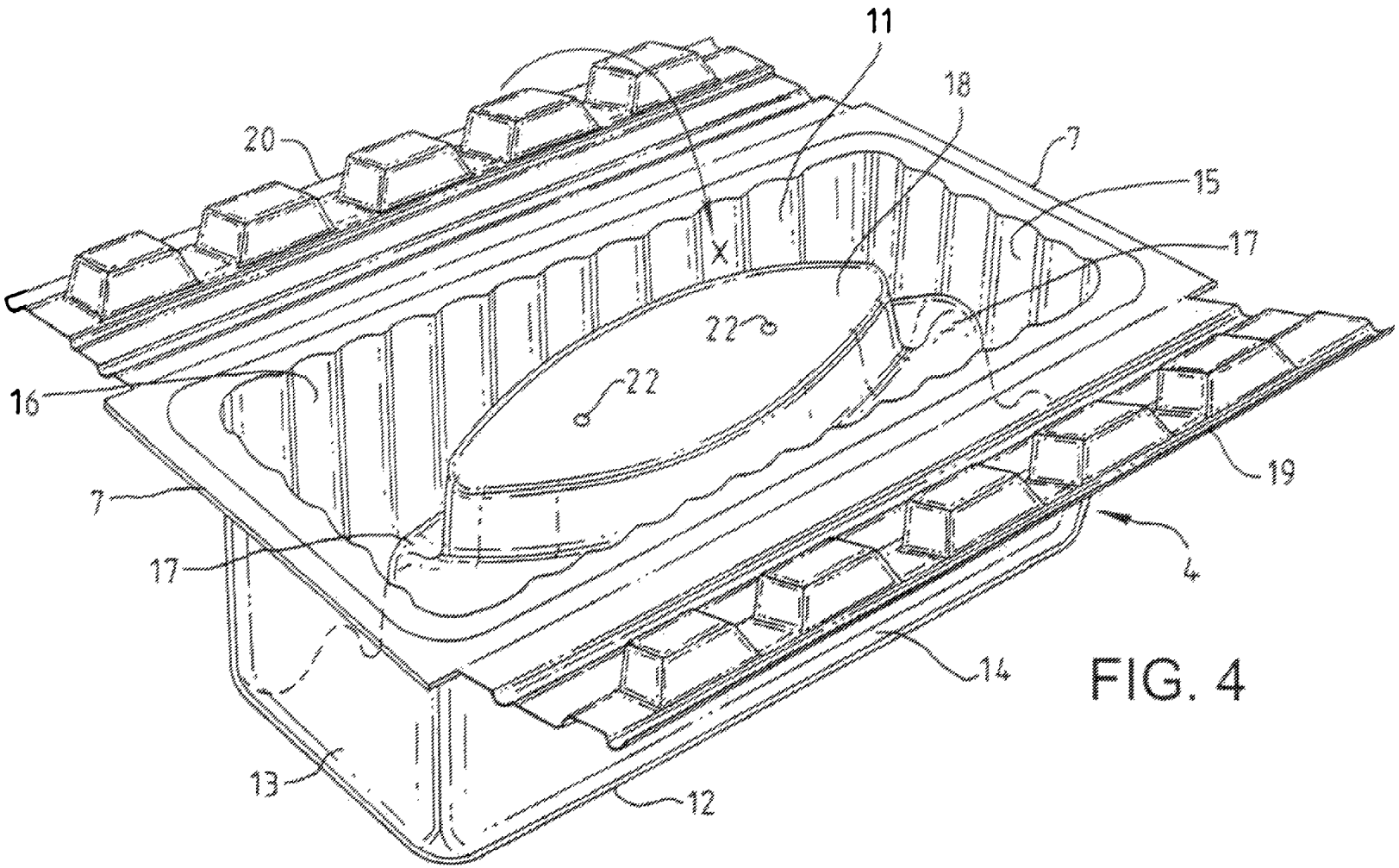
FIG. 4 is a schematic perspective view of first example of a container.

Referring to FIG. 4, the container 4 is manufactured as a one piece moulding of a thermoplastics material and comprises a generally rectangular opening 11 bounded by the lip 7, a base 12, and sidewalls 13, 14, 15, 16 that extend from the base to the opening and the lip 7. The sidewalls 13, 14, 15, 16 are corrugated to provide rigidity.

The dimensions of the opening 11 are chosen to allow the insertion of a particular denomination of banknote, with the sidewalls 14, 16 being longer than sidewalls 13, 15.

The base 12 is moulded to include corrugations 17 that are disposed between a central, base support region 18 and the sidewalls 13, 16. In this example, the base support region 18 is elliptical but as will be evident hereinafter, other shapes can be used. The corrugations 17 act as a compression spring to urge the base support region 18 towards the opening 11 as successive banknotes are inserted into the container 4.

Elongate, castellated wings 19, 20 are hingedly coupled to the lip 7 along the long sides of the container 4. The wings 19, 20 are initially in the configuration shown in FIG. 4 and as a result, a plurality of containers 4 can be stacked one within the other, enabling a supply of containers to be easily delivered and stored adjacent to the packaging device 1 at the point of sale, ready for use.

In order to prepare a container 4 for use in the packaging device 1, a relatively rigid rectangular radio frequency identification (RFID) tag 21 (not shown in FIG. 4 but illustrated in FIG. 8) is placed on the base support region 18. The RFID tag 21 may be in the form of a printed coil or other techniques may be used. More information about RFID tags can be obtained from the RFID Handbook, Klaus Finkenzeller, 1999, John Wiley & Sons. In the present embodiment, the RFID tag 21 is a read/write tag. Typically, such a tag has a read range of about 2 meters and is capable of storing around 2 KB of data. Reference is also directed to International Standard ISO 15693 for details of a specification of RFID tags that operate in the 13.56 MHz frequency band.

The RFID tag 21 may comprise a moulded plastics member that couples to the base support region 18 by cooperating pegs and receptacles 22. The RFID tag 21 extends to the sidewalls of the container 4 to support the banknotes. Thereafter, the wings 19, 20 are hinged inwardly from the position shown in FIG. 4, in the direction of arrows X. As explained in more detail hereinafter, the wings 19, 20 when folded inwardly, act as guide rails to allow banknotes to be passed along them for insertion into the container 4 through the opening 11.

Figure 5:
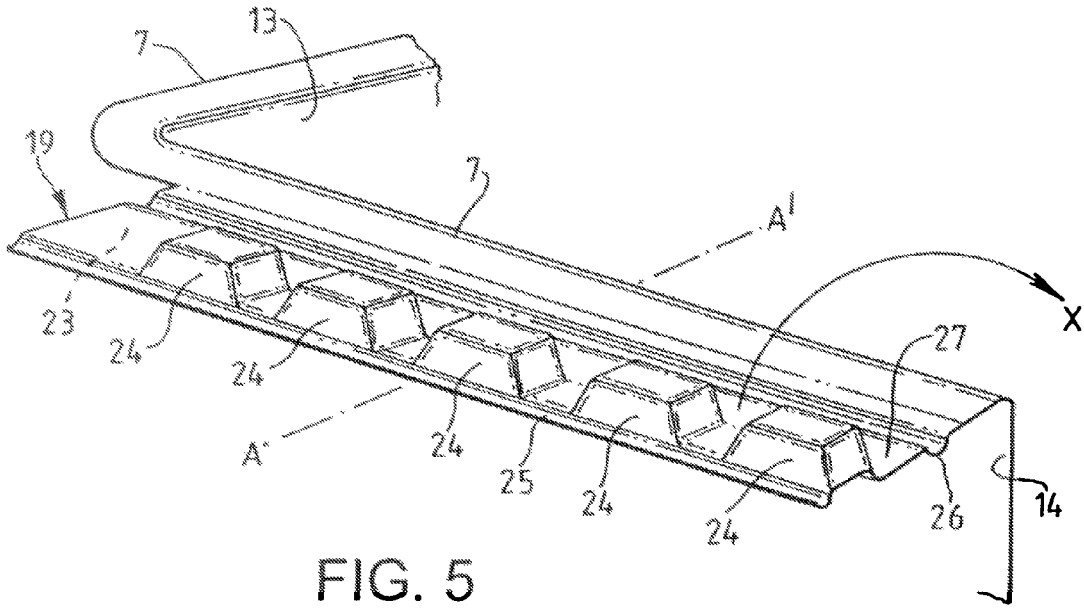
FIG. 5 is partially broken away perspective view of the container with one of its support rails in an open position.
Figure 6:
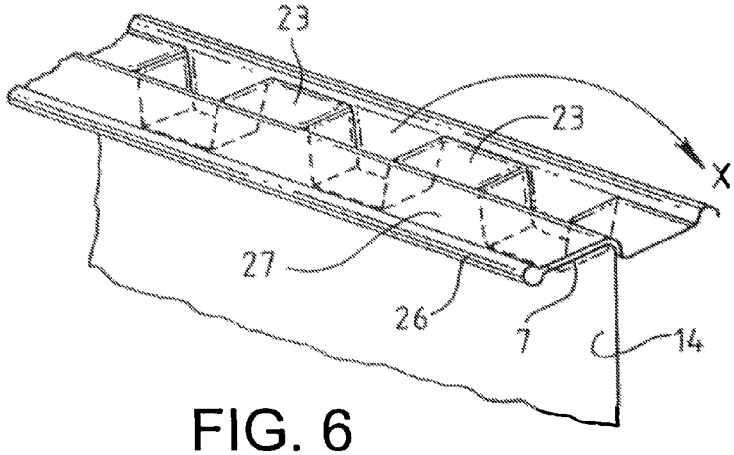
FIG. 6 corresponds to FIG. 5 but with the support rail in a closed position.

The wing 19 is shown in its initial, outwardly extending position in FIG. 5 and its inwardly folded position in FIG. 6. The wing 19 comprises a main guide surface 23 formed with a series of indentations that give rise to castellations 24, an outer lip 25, a hinge line 26 and a coupling surface 27 that connects the main guide surface 23 to the hinge line 26.

Figure 7A:
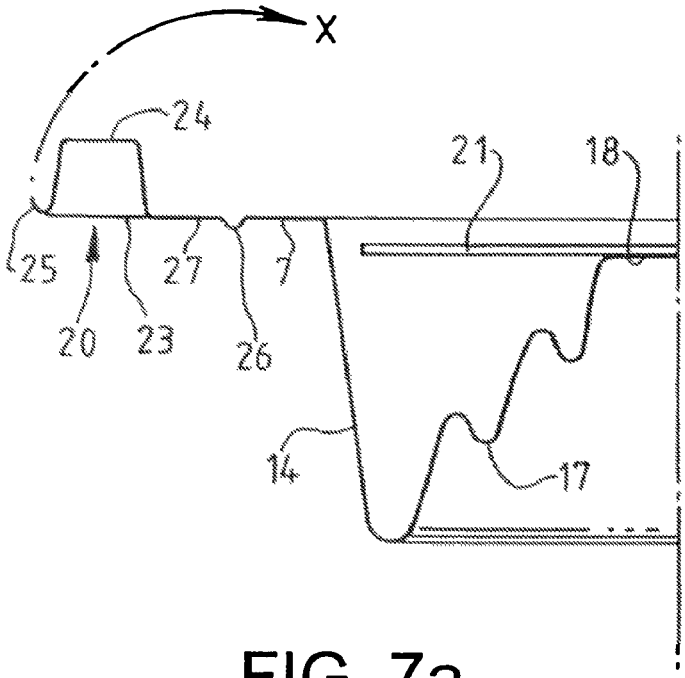
FIG. 7*a* is a partial sectional view of one side of the container when empty taken along the line A-A' of FIG. 5 with the support rail in the open position.
Figure 7B:
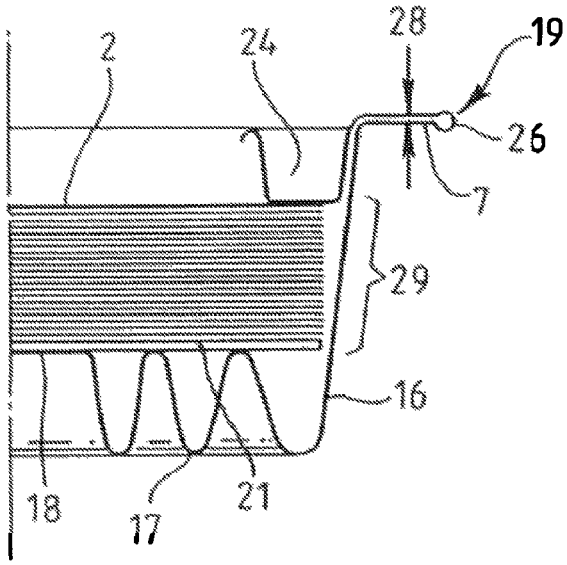
FIG. 7*b* is a partial sectional view of the other side of the container when full of banknotes, taken along the line A-A' of FIG. 5 with the support rail in the open position.

When the wings 19, 20 are folded inwardly in the direction of arrow X, and the container 4 is inserted into the packaging device 1, the coupling surface 27 is welded to the lip 7 by the packaging device 1, in the region 28 shown in FIG. 7*b*.

In FIG. 7*a*, the wing 19 is shown in its initial, outwardly extending position, with no banknotes 2 in the container 4 and with the spring corrugations 17 in their initial, uncompressed state. FIG. 7*b* illustrates the configuration when the container 4 has been filled with a stack 29 of banknotes 2. In this situation, the RFID tag 21 has been compressed downwardly to accommodate the stack 29 of banknotes thereby compressing the corrugations 17 in the base of the container 4. The wing 19 has been hinged inwardly in the direction of arrow X and welded in region 28 against lip 7 so that the castellations 24 provide a downwardly depending stop to hold the stack 29 of banknotes within the container 4.

Figure 8:
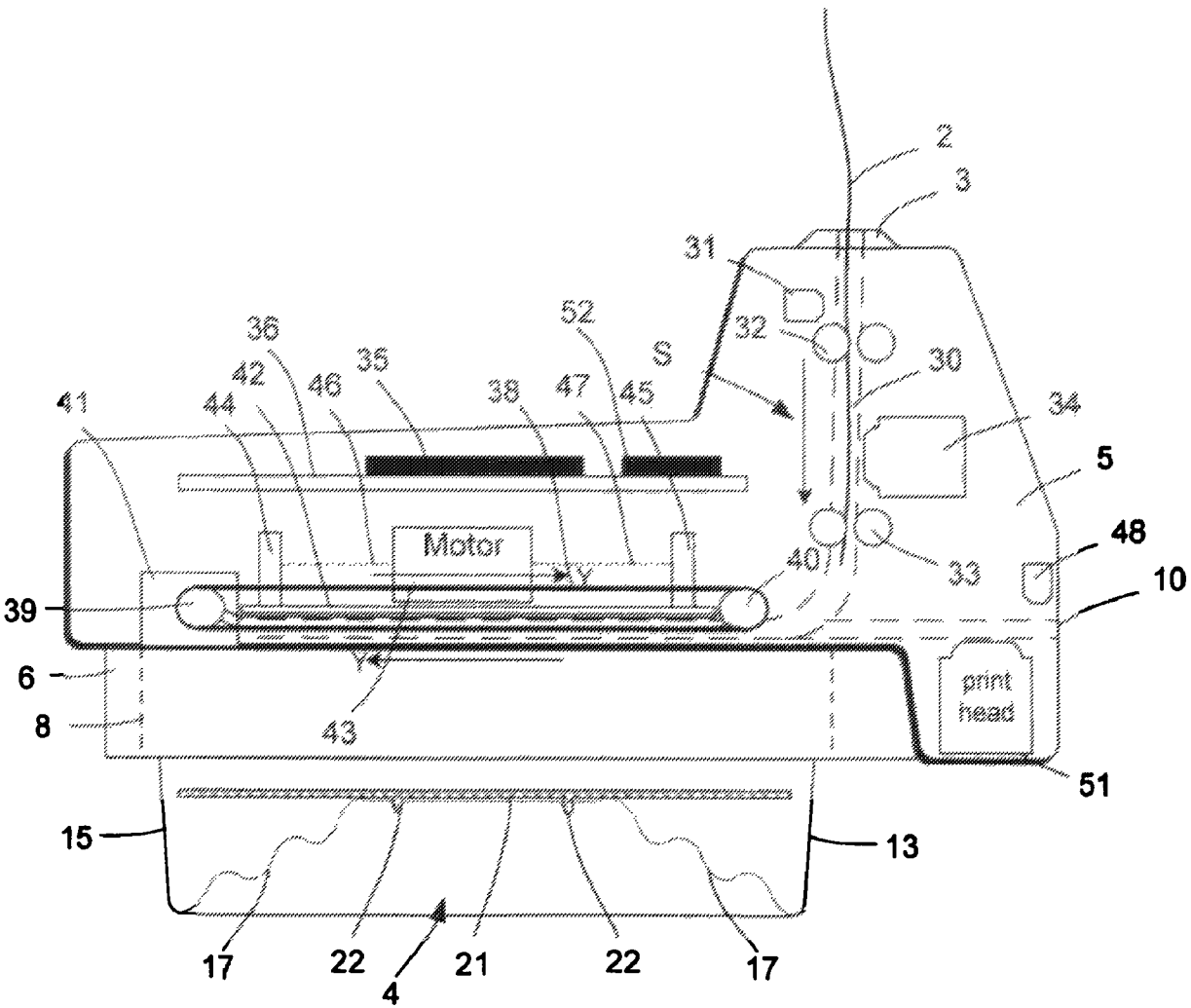
FIG. 8 is a longitudinal, sectional view of the packaging device with the container empty.

The way in which the packaging device 1 fills the container 4 with banknotes 2 will now be described in more detail. Referring to FIG. 8, a cross sectional view of the packaging device 1 is shown, with the container 4 received in frame 6, empty and ready to receive banknotes 2. The wings 19, 20 of the container 4 have been folded inwardly into the position shown schematically in FIG. 2, and are clamped in this position between the main body 5 and the frame 6. The main body 5 includes an input path 30 that extends from the first input port 3 through a banknote sensing station S, to the output port 8 in frame 6. When the banknote 2 is inserted into the first input port 3 it is detected by an optical sensor 31 that activates driven roller pairs 32, 33 to drive the banknote 2 past a validation sensor arrangement 34 coupled to validation circuitry 35 mounted on a printed circuit board 36. The validation sensor arrangement 34 and associated circuitry 35 may correspond to our Ardac technology described in U.S. Pat. No. 4,348,656. In the event that the banknote 2 is determined to be a true banknote as opposed to a fraud by the sensor arrangement 34 and associated circuitry 35, the drive roller pairs 32, 33 transport the banknote 2 towards the output port 8. Otherwise, the roller pairs 32, 33 are driven in reverse so that the banknote 2 is ejected from the input port 3.

Figure 9A:
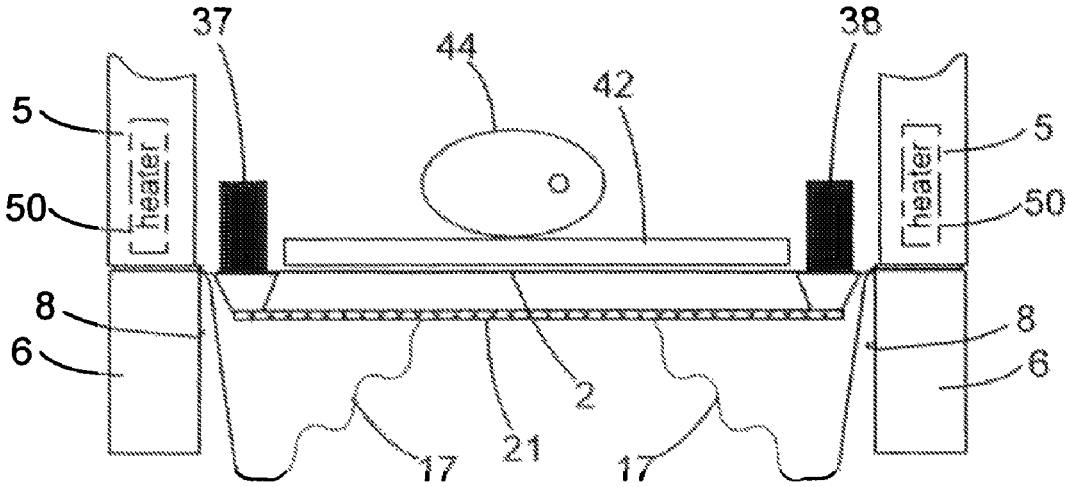
FIG. 9*a*-9*d* are views of the packaging device in transverse section illustrating operation of the drive mechanism to fill the container.

Assuming that the banknote 2 is acceptable, it is passed by the rollers 32, 33 towards a banknote drive mechanism, which in this example includes a pair of drive belts 37, 38 shown more clearly in FIG. 9*a*, which engage longitudinal side edges of the banknote 2 and move it into alignment with the output port 8. Considering the belt 38 in more detail, it extends between pulleys 39, 40 which are driven by a motor 41 in the direction of arrows Y such that the banknote 2 is drawn by the belts 37, 38 in a direction transverse to its major face along the input path 30 until it becomes aligned with the output port 8.

The banknote drive mechanism also includes a plunger 42 in the form of a rigid plate that is mounted for movement downwardly between the belts 37, 38 so as to to drive the banknote 2 into the container 4. To this end, a motor 43 drives two pairs of elliptical cams 44, 45 through a drive train 46, 47 illustrated schematically in dotted outline. In use, the cams 44, 45 rotate in the direction of arrows Z (shown in FIG. 9*b*)

to drive the plunger 42 together with the banknote 2, into the container 4 through the opening 11, in a direction perpendicular to the plane of the banknote when it arrives at the opening 11 along the input path 30.

Figure 9B:
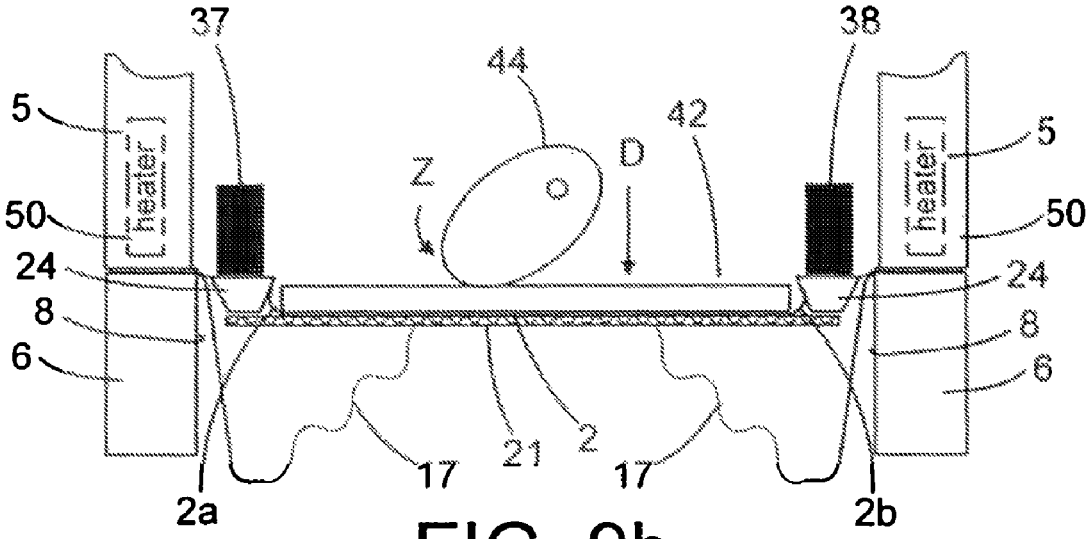

This process is shown in more detail in FIGS. 9*a*-9*d*. Referring to FIG. 9*a*, the banknote 2 is driven by belts 37, 38 along the main guide surfaces 23 of the inwardly folded wings 19, 20. The main guide surfaces 23 act as rails to support the longitudinal side edges of the banknote 2. When the banknote 2 becomes aligned with the output port 8 in the frame 6, the motor 43 is operated to rotate the cams 44, 45 downwardly as shown in FIG. 9*b*. As a result, the plunger 42 is moved downwardly in the direction of arrow D so that the banknote 2 is moved downwardly into the container past the wings 19, 20 thereof. Side edges 2*a*, 2*b* of the banknote deform so that they withdraw from the main guide surfaces 23 as the plunger 42 moves downwardly past the castellations 24, so that the entire banknote 2 is moved into the container 4. As the cams 44, 45 continue to rotate, the plunger 42 and the banknote 2 are driven downwardly against the RFID tag 21, such as to compress the corrugations 17, thereby allowing the side edges 2*a*, 2*b* of the banknote 2 to lie flat and become disposed underneath the castellations 24.

Figure 9C:
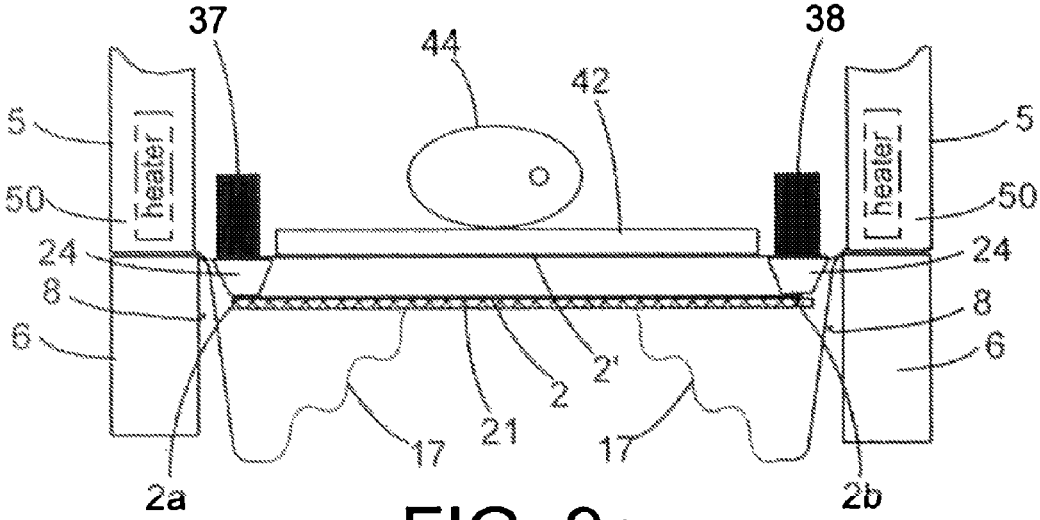

The cams 44, 45 are then rotated to their initial position ready to engage the next banknote 2' shown in FIG. 9*c*. Thus, the banknote 2 is inserted into the container 4 and is held therein by the compressive force of the spring corrugations 17, against the castellations 24, which act as a stop to hold the banknote 2 in the container 4.

Figure 9D:
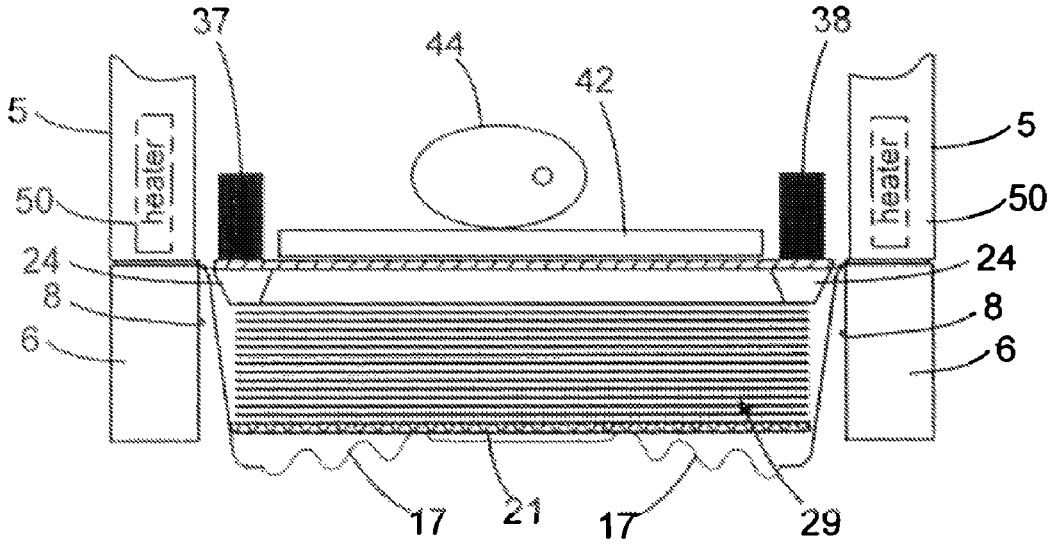

Successive banknotes are inserted into the container 4 to form the banknote stack 29 as shown in FIG. 9*d*, with the uppermost banknote being held under the castellations 24.

Figure 10:
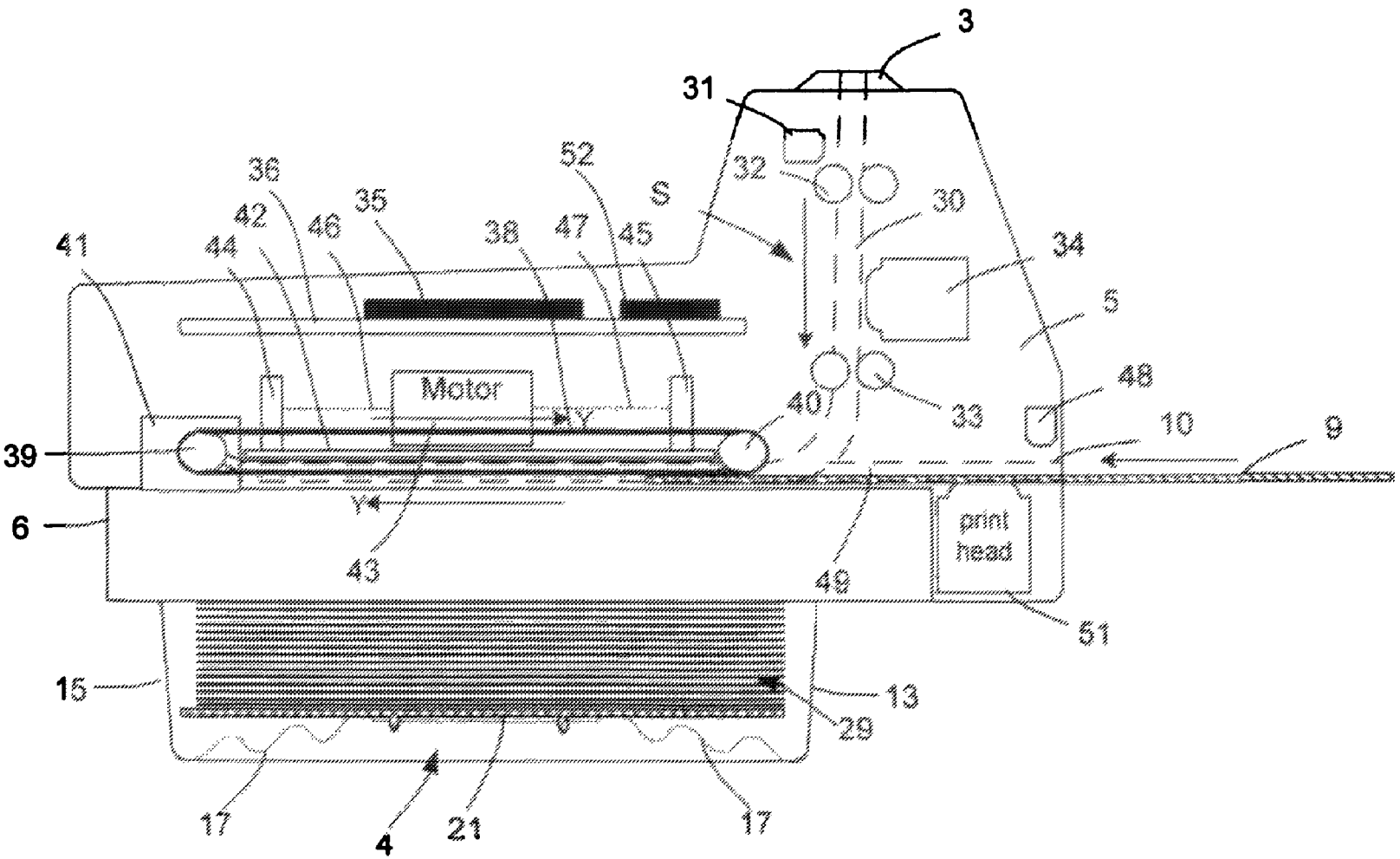
FIG. 10 corresponds to FIG. 8 but with the container full.

FIG. 10 shows the stack 29 in the container 4, with the RFID tag 21 having been moved downwardly. The compressive force of the spring corrugations 17 urges the stack 29 upwardly against the castellations 24 to hold the banknotes securely within the container 4.

When the container 4 is full, an operator inserts the closure member 9 through the second input port 10. The closure member 9 comprises an optically transparent or translucent sheet of plastics material. The closure member 9 is detected by an optical sensor 48 and moves along a closure member inlet path 49 that extends into the input path 30 for banknotes, so as to become engaged with and driven by the drive belts 37, 38 until it becomes aligned with the output port 8, in a similar manner to the stacking of the banknotes. The closure member 9 thus becomes positioned over the inlet 11 of the container 4 with the side edges of the member 9 extending over the main guide surfaces 23 of the wings 19, 20 on the longer sides of the container 4, and also over the lip 7 on the shorter sides of the container 4. As shown in FIG. 9*d*, the main body 6 of the packaging device includes electrical heaters 50. In use, when the closure member 9 becomes aligned with the opening 11 of the container 4, the heaters 50 are switched on so as to heat seal the closure member 9 onto the wings 19, 20 and also to weld the wings themselves onto the lip 7 of the container 4, i.e. to produce the weld 28 shown in FIG. 7.

As shown in FIG. 10, the main body 5 includes an RFID reader/writer 52 operable to read data from or write data to the RFID tag 21. The validation sensor arrangement 34 and associated circuitry 35 are operable to determine the monetary value attributed to each banknote packaged in the container 4. Thus, value data comprising information such as the monetary value attributed to each banknote packaged in the container 4 and the number of banknotes of different denominations, in addition to other information, can be written on the RFID tag 21 using the RFID reader/writer 52.

After sealing of the closure member 9 on the container 4, the frame 6 can be opened as shown in FIG. 2 and the sealed container can be transported to another location, for example to the cashier's office. The resulting packaged banknotes cannot readily be tampered with during transport because the closure member 9 is heat sealed to the container 4 protecting its contents. If the sealed container 4 is opened, this is readily apparent and the container 4 cannot be subsequently reused in the packaging device 1. Thus, the risk of fraud is materially reduced.

Figure 11:
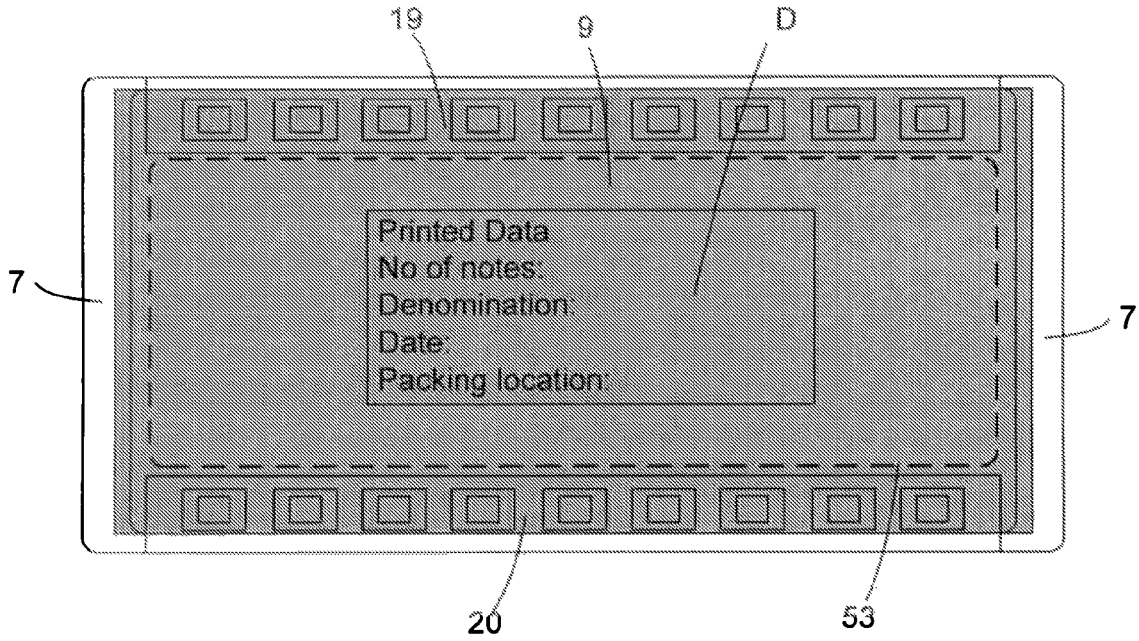
FIG. 11 is a top plan view of the container shown in FIG. 10.

FIG. 11 illustrates the container 4 in plan view with the closure member 9 heat sealed onto the wings 19, 20 and the lip 7. Printed data, such as the number of notes in the container, their denomination and the time and place where they were packaged may be printed on the underside of the closure member 9 by means of a print head 51 shown in FIG. 8, which prints data D fed thereto by circuitry 35 when the closure member 9 is inserted through inlet 10.

The closure member 9 includes a line of weakness 53 to facilitate opening the container 4 when filled with banknotes. The closure member 9 can be burst open by causing the closure member 9 to tear along the line of weakness 53. The contents can then be removed.

It will be understood that the container 4 cannot be reused for packaging banknotes in the packaging device 1 once the container 4 has been opened, providing a clear visual indication of whether the container 4 has been tampered with after closure. Moreover, when opened, data printed on the closure member 9 or data derived from the RFID tag 21 can be used to verify the contents of the container 4.

An example of a device according to the invention will now be described, for opening and counting the contents of the container 4.

The device 54 consists of a secure, tamper-proof housing 55, with a hinged door 56 that can be opened to provide access to a chamber 57 into which an upturned container 4 is inserted. The container 4 has been filled with banknotes together with a RFID tag 21 and has a closure member 9 sealed thereto, as previously described.

The chamber 57 includes a support surface 58 that includes a release aperture 59 with dimensions corresponding to the opening 11 of the container 4. An opening device within the housing 55 includes a ram 60 drivable downwardly in the direction of arrow R by means of electric motors 61, 62 that drive toothed pinions 63, 64 which engage toothed racks 65, 66 mounted on the ram 60. The motors 61, 62 are controlled by processor 67 that controls the overall operation of the device. The processor 67 may include a microcontroller with associated memory as well known per se in the art.

Also included within the housing 55 is a banknote counting device 68 which comprises a paddle wheel assembly that includes a roller 69 driven by an electric motor (not shown) under the control of the processor 67. A plurality of generally radially extending, resilient paddles 70 for example made of plastics material, are mounted on the roller 69. Paddle wheel counters are known per se in the art, for example the Model 2800VB counter by De La Rue Cash Systems Inc. In use, individual banknotes are fed between next adjacent pedal wheels 70 to be counted and are then removed from the counting device 68 by means of a scraper blade 71 that feeds successive banknotes to a sorter 72 that comprises a vertically reciprocal carriage 73 with depending trays 74-77 that individually receive different denominations of banknotes.

In this example, the sorter 72 has its trays 74-77 disposed exteriorly of the housing 55 but in a modification, the housing 55 may include an extension 78 shown in dotted outline which is only openable by an operator after counting of the banknotes has been completed within the device.

Figure 12:
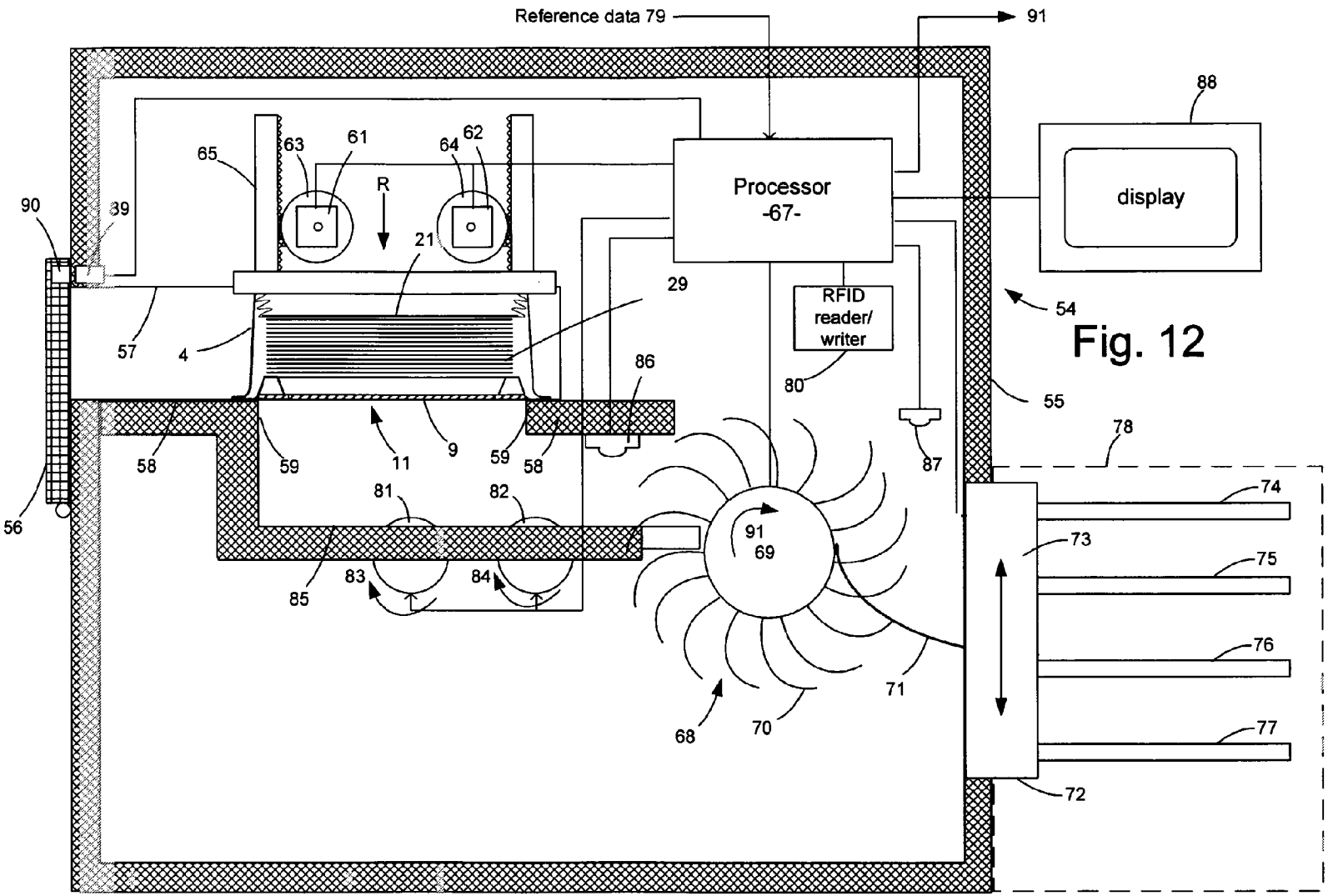
FIG. 12 is a sectional view of a container processing device for emptying the contents of the container and counting them, ready for use.

The processor 67 is configured to receive reference data corresponding to the number of banknotes and their denomination. The reference data may be received from a remote location through an input connection 79. For example, the packaging device 1 may provide data concerning the number and denomination of banknotes placed in container 4 and this information may be sent to the device shown in FIG. 12 through a network or a telecommunications link. Alternatively, the reference data may be collected through the use of a RFID reader/writer 80 which reads corresponding reference data from RFID tag 21 when the container 4 is received in the chamber 57.

Feeding means in the form of rollers 81, 82 are driven by motors (not shown) in the direction of arrows 83, 84 under the control of processor 67 to feed banknotes from the container 4 individually between successive paddles 70. The rollers 81, 82 protrude through a guide surface 85 onto which the banknotes from container 4 are deposited when the container 4 is opened. A banknote denomination sensor 86 detects different denominations of banknotes as they are fed successively to the counter device 68. In this example, the denomination sensor 86 comprises a colour sensitive photodetector for detecting banknotes of different denomination that are of different colours. The denomination sensor 86 provides an input to the processor 67.

A counting sensor 87, which may be an optical sensor, detects the passage of successive banknotes as they are transported radially around the roller 69 of the counting device 68. The output from the counting sensor 87 is fed to the processor 67. In practice, there may be several sensing devices which feed count information to the processor 67. For example the angular rotation 69 may be sensed along with a check that a banknote is fed between successive paddles 70, to enable the processor to develop a count signal corresponding to the number of banknotes.

A display 88 which may comprise an LCD panel or other suitable electronic display, is connected to the processor 67 in order to provide a display of the count signal corresponding to the number of banknotes, their denomination and other data, to provide the user with detailed information about the banknotes that are counted and stacked on the respective trays, 74-77.

The processor 67 also receives an input from a door sensor 89 which may comprise a Hall effect switch that cooperates with a magnet 90 in order to detect closure of the door 56.

The device 54 can be used to open the container 4 and count its contents within the tamper proof housing 55 so as to develop account signal under conditions in which pilfering can be prevented.

In use, the door 56 is opened and the upturned container 4 is inserted into the chamber 57 so that its opening 11 is aligned with release opening 59. The door 56 is then closed and as a result, sensor 89 signals to the processor 67 that it is safe to open the container 4.

Figure 13:
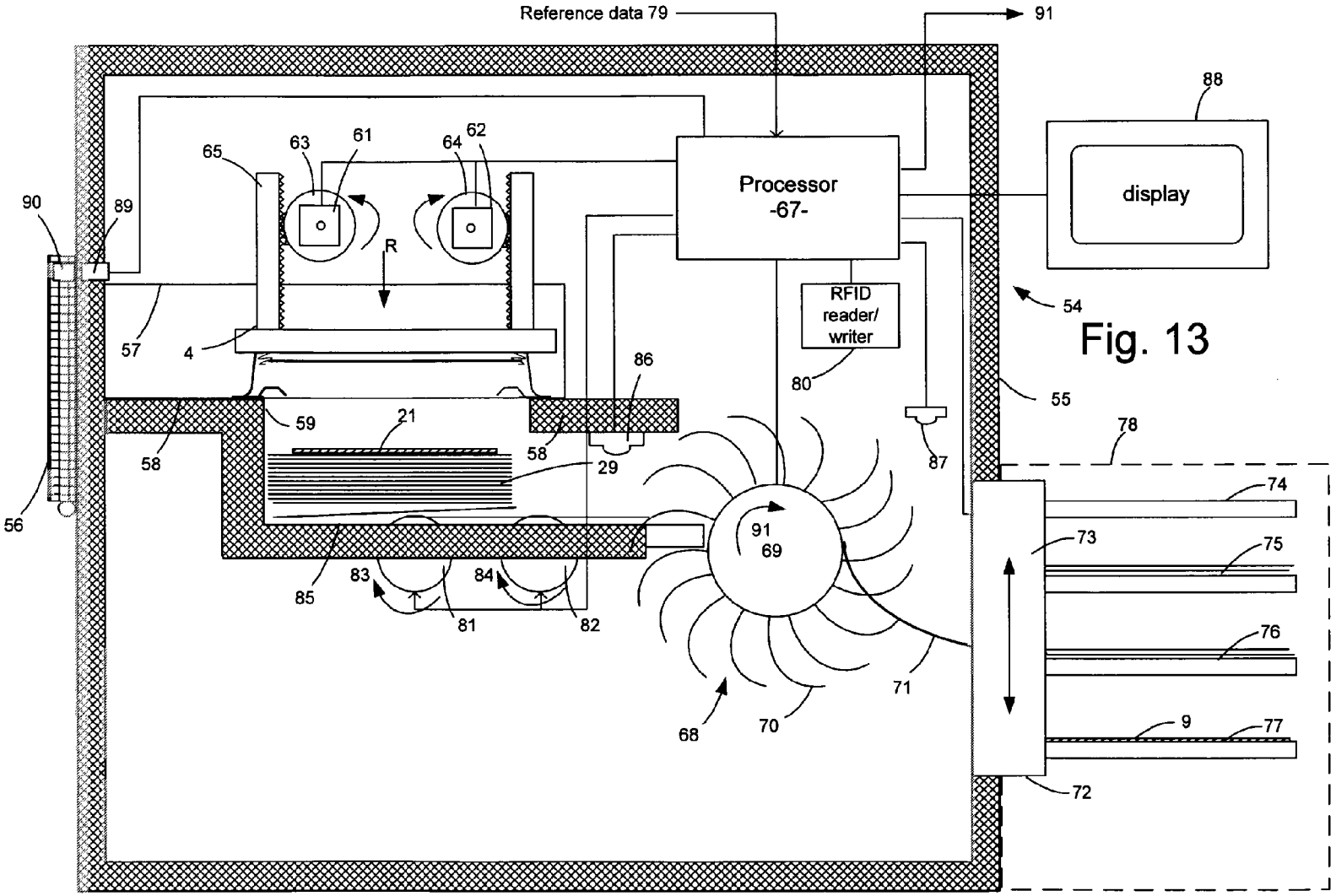
FIG. 13 corresponds to FIG. 12 with the device in use after opening the container.

The processor 67 then activates the motors 61, 62 so as to drive the rack and pinion assemblies 63-66, causing the ram 60 to press downwardly onto the container 4 as shown in FIG. 13. The sealed plastics container 4 is burst open, with the closure member 9 breaking open along the line of weakness 53 illustrated in FIG. 11. As a result, the stack of banknotes together with the RFID tag 21 and the burst open portion of the closure member 9, are deposited in a stack onto guide surface 85.

The processor 67 then actuates the feed rollers 81, 82 so as to feed successive banknotes from the bottom of the stack 29 into the spaces between successive paddles 70 of the counting mechanism. The roller 69 of the counting mechanism is rotated in the direction of arrow 91 causing successive banknotes to pass the counting sensor 87, so that the processor 67 can build up a count signal corresponding to the number of banknotes counted. Scraper blade 71 feeds successive banknotes from the roller 69 towards the sorter 72.

The carriage 73 of sorter 72 is reciprocated upwardly and downwardly under the control of processor 67 depending upon the denomination of the banknote detected by denomination sensor 86. As a result, each of the trays 74-77 builds up stack of banknotes of an individual denomination.

The tray 77 of the sorter 72 is reserved for the burst portion of the closure member 9. As previously described, printed data corresponding to the contents of the container may be printed onto the closure member 9 and this data can be used as a visual check to verify the number and denomination of banknotes on the other trays 74-76. Another of the trays may be reserved for the RFID tag 21.

Thus, the processor 67 builds a count signal and data corresponding to the denomination of the banknotes counted from the container 4 when opened. The resulting data can be checked against the reference data received by the RFID reader/writer 80 and additionally or alternatively against reference data received through input 79. After use, the data on the RFID tag 21 may be erased by the reader/writer 80 so that the tag 21 can be re-used and also for security purposes to ensure that the data is not read by other parties.

The resulting count signal and denomination information is fed by the processor to be displayed by the display device 88. In the event that the data derived by the device does not correspond with the reference data, the processor signals an alarm and the corresponding alarm may be presented on display 88. The displayed alarm may inform an operator of the particular event that has triggered the alarm. Such events may include a discrepancy in the total number of notes counted, a discrepancy in the number of a particular denomination of note counted or a discrepancy in the monetary value attributed to the contents of the container 4. In the case that the reference data comprises information relating to the journey of the container from a point of sale to the device 54, the event may be that the length of the journey exceeds a predetermined time limit or that the route of the journey deviated from a predetermined route. Additionally, the processor 67 may signal on output 91 to a remote computer e.g. part of an accounting system, that an error has occurred. Also, an alarm bell (not shown) may be sounded.

Thus, the counting of the contents of the container 4 can be carried out according to the invention under secure conditions. Once the count signal has been established by the processor 67 and signalled either on the display 88 or to the remote computer on line 91, it becomes difficult for an operator to remove banknotes since it then becomes plainly evident that the pilfering has occurred as a result of operation of device 54, thus signalling that it is the operator who has stolen one or more banknotes from the opened container. This heightened accountability thus discourages pilfering.

After the counting is completed, the door 56 is opened and the remaining shell of the container 4 is removed from the device and may then be disposed by being sent to a plastics recycling facility.

Many modifications and variations to the described example of the invention fall within the scope of the claimed invention. For example the sorter may not have a movable carriage and the scraper blade may include a diverter to direct banknotes of different denominations to the trays of the sorter.

Also, whilst the device has been described for use with banknotes it can be used with tokens, vouchers and other sheet objects.

The invention claimed is:

1. A device for processing sheet objects, comprising a housing that contains:

(a) a container of resiliently deformable material containing the sheet objects wherein the container is sealed shut with the sheet objects therein, (b) an opening device operable to receive the container and being operable to burst the container and open the container within the housing, and (c) a counter configured to count the sheet objects from the opened container within the housing and produce a count signal corresponding to the number of the sheet objects counted, each sheet object having a denomination.

2. A device according to claim 1 wherein the housing includes a door operable to allow the container containing the sheet objects inserted therein to be opened by the opening device.

3. A device according to claim 2 wherein the opening device is configured to be operable only when the door is closed.

4. A device according to claim 1 including processing circuitry responsive to a count signal generated by the counter and operable to compare the value of the count signal with reference data corresponding to the number of the sheet objects within the container.

5. A device according to claim 4 including a detector configured to detect the reference data.

6. A device according to claim 5 wherein the detector comprises a RFID tag reader configured to detect the reference data from a RFID tag in the container.

7. A device according to claim 4 wherein the processing circuitry includes an input configured to receive said reference data from a remote location.

8. A device according to claim 4 wherein the processor is configured to provide an alarm signal if the count signal does not correspond to the reference data.

9. A device according to claim 8 including a display for displaying the alarm signal.

10. A device according to claim 4 wherein the reference data includes information corresponding to the denomination of the sheet objects in the container.

11. A device according to claim 4, wherein the processor is configured to provide an alarm signal if the numbers of sheet objects of a particular denomination does not correspond to the reference data.

12. A device according to claim 4, wherein all of the sheet objects have a total monetary value and the processor is configured to provide an alarm signal if the total monetary value attributed to the sheet objects does not correspond to the reference data.

13. A device according to claim 1 including a denomination sensor to sense the denomination of the sheet objects from the container.

14. A device according to claim 13 including a sorter responsive to the denomination sensor and configured to sort the counted sheet objects according to their denomination.

15. A device according to claim 1 including a sheet feeder within the housing configured to feed the sheet objects from the opened container to the counter.

16. A device for processing sheet objects in a sealed container, the sealed container containing the sheet objects therein, comprising:

a lockable housing to receive the sealed container therein, an opening device to open the container when received in the housing and the housing is locked closed, a counter configured to count the sheet objects from the container within the locked sealed container, the device being so configured that access to the sheet objects in the container is only permitted after the sheet objects have been counted by the counter, means to receive data corresponding to the sheet objects of the container, and means for checking the contents counted by the counter against said data before access is permitted to the sheet objects counted by the counter.

17. A device according to claim 16 including a sorter disposed within the housing and configured to sort the sheet objects, the device being so configured that access to the sheet objects is only permitted after the sheet objects have been sorted by the sorter.

* * * * *

UNITED STATES PATENT AND TRADEMARK OFFICE

CERTIFICATE OF CORRECTION

PATENT NO. : 7,857,198 B2
APPLICATION NO. : 11/720220
DATED : December 28, 2010
INVENTOR(S) : Malcolm Reginald Hallas Bell It is certified that error appears in the above-identified patent and that said Letters Patent is hereby corrected as shown below:

Claim 16, column 10, line 29, please delete the word "locked".

Signed and Sealed this
Twenty-ninth Day of March, 2011

David J. Kappos

David J. Kappos
*Director of the United States Patent and Trademark Office*